US005654514A

United States Patent [19]

Tracey

[11] Patent Number: 5,654,514

[45] Date of Patent: Aug. 5, 1997

[54] GUITAR, CLASSICAL ELECTRONIC

[76] Inventor: Brian Tracey, 46A Grandview Ave. West, Edison, N.J. 08837

[21] Appl. No.: 505,855

[22] Filed: Jul. 24, 1995

[51] Int. Cl.[6] ..... G10D 3/00; G10G 5/00

[52] U.S. Cl. ..... 84/327; 84/267

[58] Field of Search ..... 84/267, 290, 291, 84/327, 293

[56] References Cited

U.S. PATENT DOCUMENTS 4,632,002 12/1986 Clevinger ..... 84/291
4,686,882 8/1987 Shaw ..... 84/291
4,770,079 9/1988 Mastroianni ..... 84/291

*Primary Examiner*—Cassandra C. Spyrou

[57] ABSTRACT

A Classical guitar, comprised of a full size neck and bridge, where the dimensions of the neck and the bridge are the same as a conventional instrument. The instrument body normally used to produce sound by acting in resonance with the strings is replaced by a mechanically isolated bridge and electronic pickup which are mounted on a compact chassis. Adjustable supports are affixed to the chassis. The supports contact the player in such a manner as to hold the guitar in the correct Classical position. Integral electronics support the use of headphones for practice, and speakers for performance.

3 Claims, 5 Drawing Sheets

GUITAR, CLASSICAL ELECTRONIC

BACKGROUND OF THE INVENTION

Classical style guitars are conventionally constructed of a large wooden body to which the neck is attached. The wooden body, consisting of spaced panels, supplies the resonance which produces the acoustical sound of the instrument. Due to the shape of the body, it is necessary to raise the left leg of the player by use of a footstool in order to attain the proper playing position. The object of altering the natural height of the leg is to balance the guitar so that there is no extra energy or strain expended to hold the instrument. This leaves the player free to concentrate on the performance. A conventional guitar is supported by resting the concave side of the body on the left leg, the bottom of the guitar on the right leg, and by holding the upper back of the guitar body close to the chest.

This balance can be difficult to achieve, and over time is uncomfortable due to the need to bend the spine so that the upper torso encompasses the instrument. It is the purpose of the invention to provide the proper relationship of the instrument to the player in an effortless manner. This serves as useful training for using the conventional concert instrument.

Another object of the invention is to provide a full size instrument which is easily transportable without disassembly, without compromise on any dimension of the width of the neck or the number of frets, as is the case with some reduced size "travel guitars".

Practioners of the Classical guitar require the use of their concert instrument during the extended hours of practice necessary to produce a successful performance. A guitar that is used for practice must duplicate the concert instruments' neck and bridge dimensions in order not to have to relearn the intricate movements of the fingers on another instrument.

The invention supplies the need for a full size instrument in a fraction of the space of the conventional guitar. This makes it practicable for the performer to use the invention in situations where it would be undesirable or ungainly to transport the conventional concert instrument, and when the privacy of practicing the instrument without producing an acoustic sound is desirable.

The electronics housing contains a preamplifier, a band pass filter, an amplifier, and an electronic reverb circuit. Additionally, jacks for an external effects loop are provided so that the player may alter the sound of the instrument with any combination of commercially available units such as equalizers, chorus units, and the like.

The band pass filter is provided with the invention in order to eliminate the sound of the left hand fingers as they run up and down the lower three strings, which are wirewound. This noise is generally considered objectionable to the Classical performer. The reverb circuit is supplied with the invention in order to enhance the sound of the piezoelectric pickup, making the invention approximate the sound of a conventional instrument.

In the practice of the invention, the neck is held to the chassis by a pivot, and by the tension of the strings. This allows the player to adjust the "action", or the distance between the strings and the neck, by turning a knob. This pivot arrangement also makes it possible for the guitar to be disassembled by loosening the strings, and releasing the knob.

Relevant examples of previous work include U.S. Pat. No. 4,632,002 to Clevinger, which discloses a transportable electric bass guitar. U.S. Pat No. 4,567,805, also to Clevinger, discloses a bridge and pickup designed to electrically reproduce the acoustic sound of the instrument. U.S. Pat No. 4,111,093 discloses a folding neck instrument. U.S. Pat. No. 4,573,391 to White discloses an inflatable knock-down guitar. U.S. Pat No. 5,078,041 describes a switchable multiple piezoelectric pickup arrangement. U.S. Pat. No. 4,750,397 to Asborth-Jones describes a pickup in which the periphery of a bimorphic transducer is secured via two mounting pads to the underside of a transverse bridge support. U.S. Pat No. 5,291,816 describes a harness designed to hold the instrument to the wearer when in a standing position.

None of the devices shown in the aforementioned patents approaches the simplicity of the neck and bridge design of this invention, and none is designed for the Classical guitar.

In prior art, guitars were made more easily transportable by mechanically complicated means. The folding neck in U.S. Pat. No. 4,111,093 is constructed of many parts, as is the inflatable guitar of U.S. Pat. No. 4,573,391. It has been discovered that the need to disassemble the guitar into its component parts for transport is infrequent, and therefore, a complicated construction is neither desired nor economical to produce. If it is desired to disassemble the invention, such as for airline travel, it is only necessary to loosen the strings and remove the pivot knob. The invention, which when assembled is 33" long and 7" wide at the bridge, is capable of fitting diagonally in a standard 22" airline carrier suitcase when disassembled.

The bridge design of the invention consists of only four parts, namely the pickup, the bridge, grommets, and screws. The pickup, a standard commercial part, is mounted on the top of the bridge. The bridge is also a standard part, as is the neck of the instrument.

A conventional instrument is 40" long, by 15" wide at the bridge, yet the 33" long by 7" wide invention maintains all critical and useful dimensions of the conventional instrument. An area of approximately 230 square inches, and over 900 cubic inches for the body alone is required to store the conventional instrument. The invention has no need of this space.

DESCRIPTION OF THE PREFERRED EMBODIMENT

Figure 1:
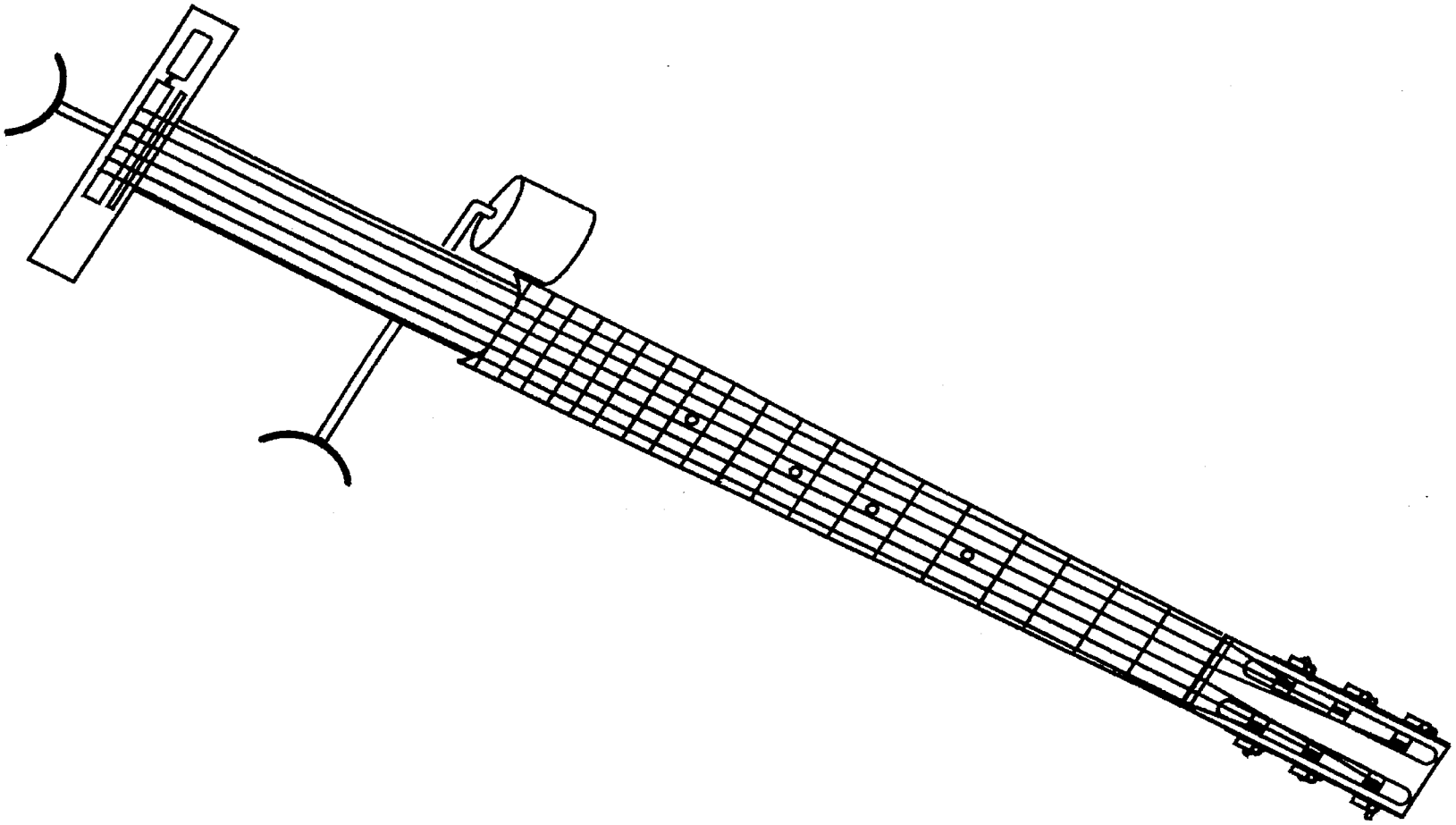
FIG. 1 is a front view illustrating a string instrument embodying the principals of the invention.
Figure 3:
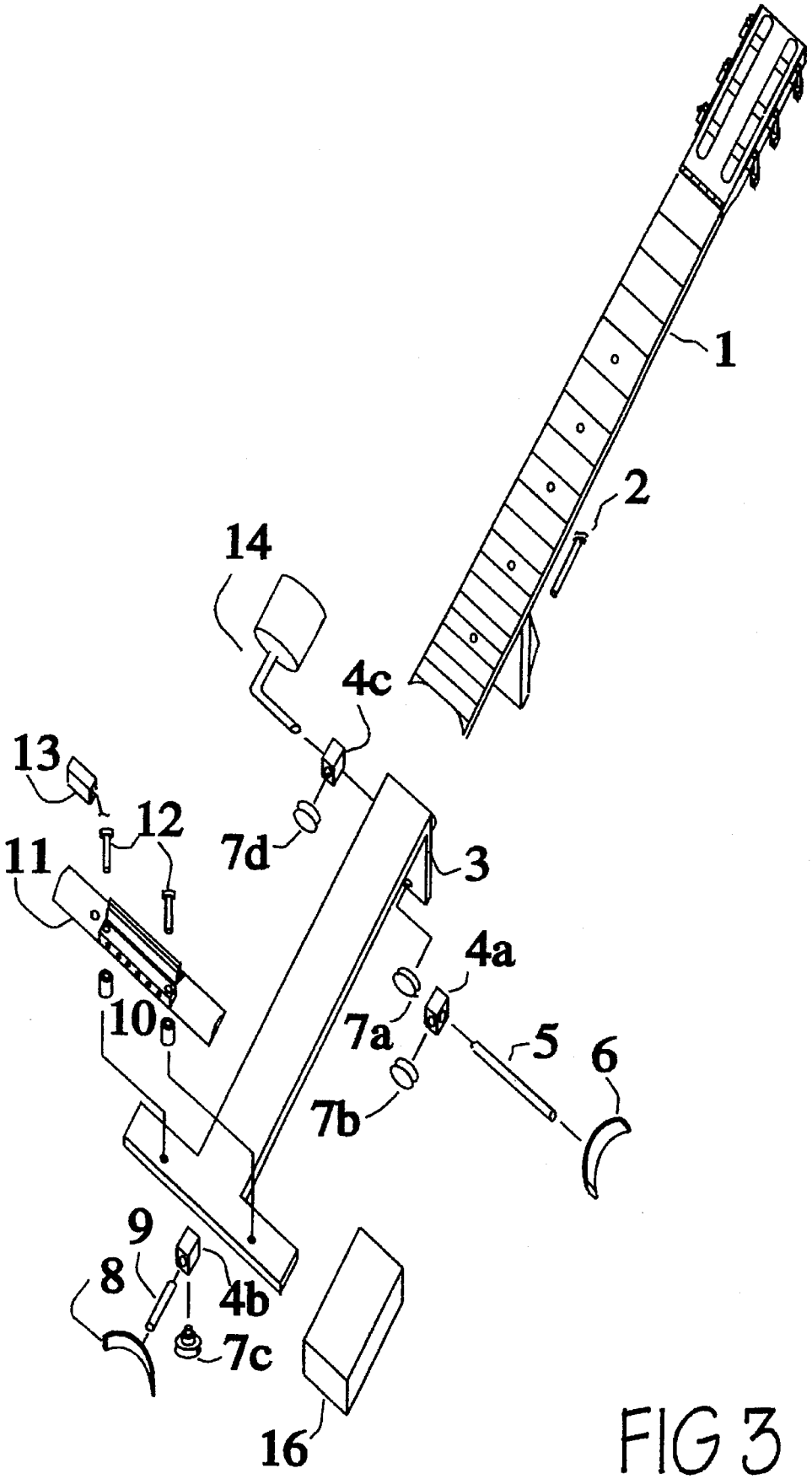
FIG. 3 is an exploded view of the invention and it's component parts.

A guitar in accord with the inventive concept is shown in FIG. 1. FIG. 3 illustrates the component parts, which basically consists of a conventional classical guitar neck 1, a chassis it, a conventional bridge 11, a piezoelectric pickup 13, amplifying electronics 16, and attachments to be described.

The neck 1 is attached to the chassis 3 by a bolt 2 inserted through the heel of the neck 1 and a corresponding round clearance hole in chassis 3. This is secured by a knob 7*a*. Left leg support 6 is attached to rod 5. Rod 5 is placed in a round clearance hole on block 4*a* at the preferred length, and secured by a knob 7*b* (for clarity, the attachment of blocks 4*a*, 4*b*, and 4*c* (quantity 3) to chassis 3 is not shown). In a similar fashion, right leg support 8 is attached to rod 9, placed in a round clearance hole on block 4*b* at the preferred length, and secured by a knob 7*c*.

Two vibration dampening grommets 10 support the bridge 11, which is attached to the chassis 3 by screws 12. A piezoelectric pickup 13 is attached to the bridge 11, and it's cable routed to electronics housing 16.

Chest support cushion 14 is placed in a clearance hole in block 4*c* at the preferred length, and secured by a knob 7*d*.

Figure 2:
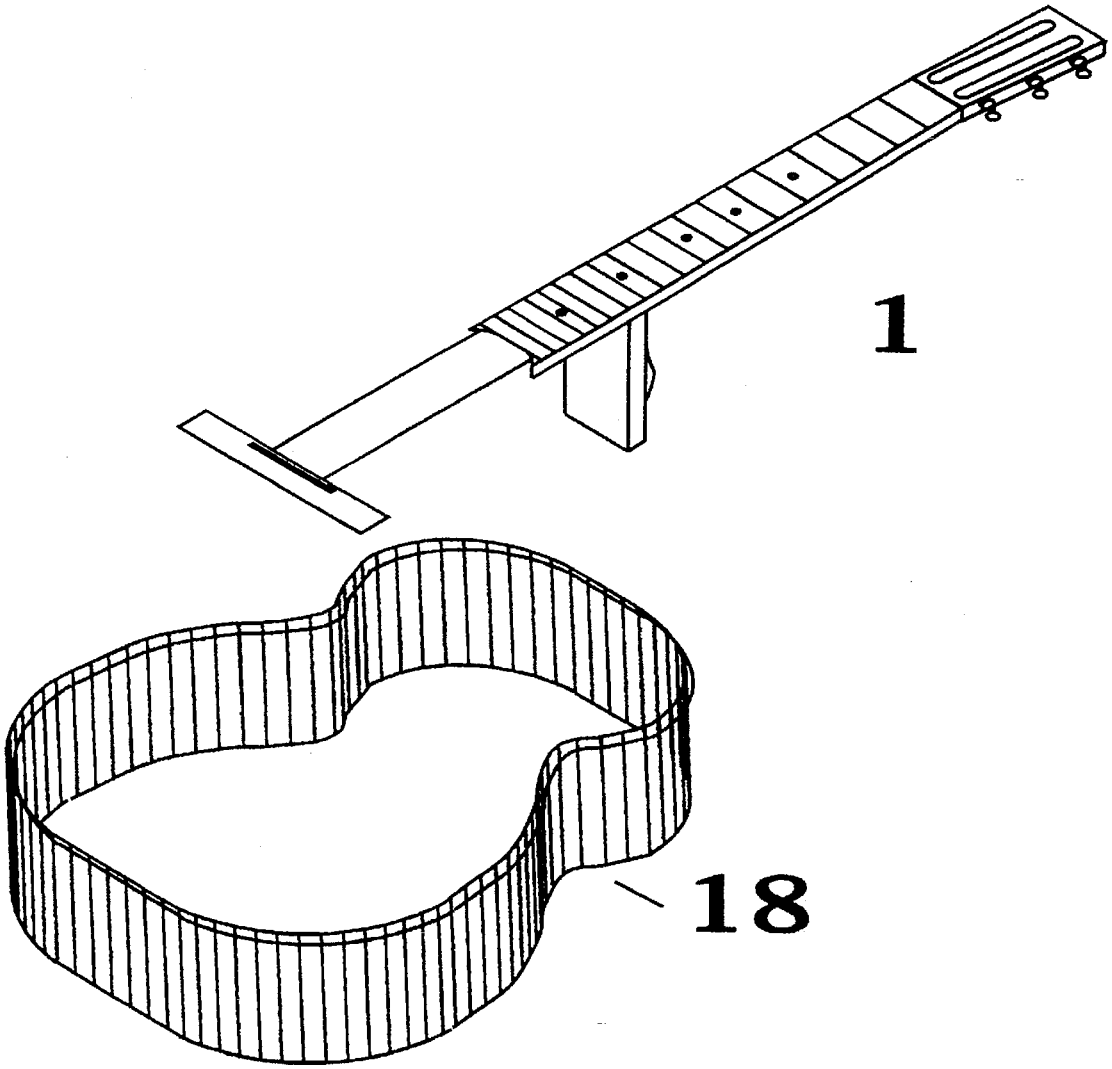
FIG. 2 is a projected view of the invention in relation to the body of a conventional instrument.
Figure 4A:
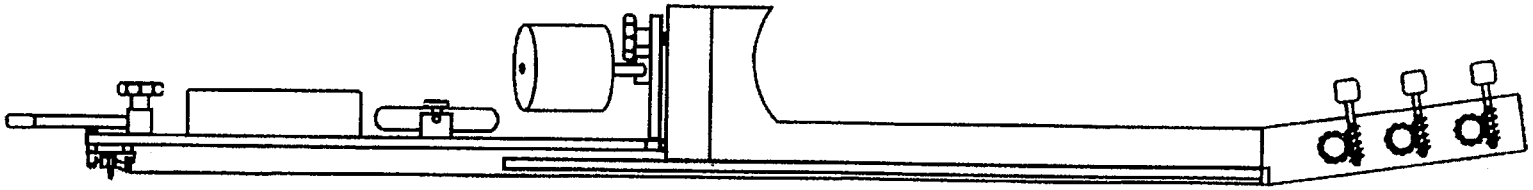
FIG. 4*a* is a side view of the invention in the vertical plane.
Figure 4B:
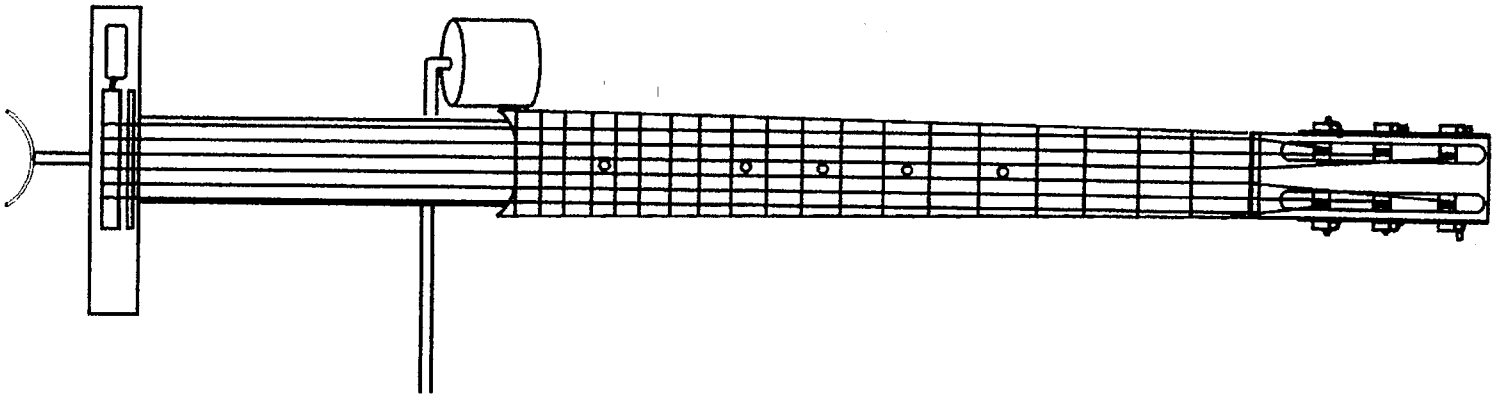
FIG. 4*b* is a front view of the invention.
Figure 5:
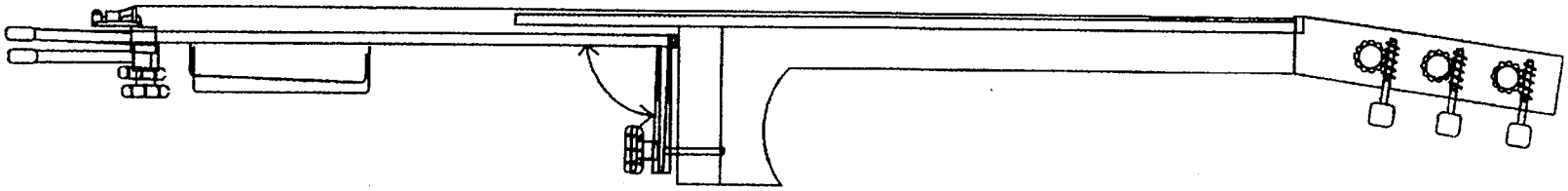
FIG. 5 is a view of the invention in the horizontal plane illustrating the neck pivot.

Electronics housing 16 is attached to chassis 3. FIG. 2 illustrates the invention in relation to the body 18 of a conventional instrument. FIG. 4*a* is a side view of the invention. FIG. 4*b* is front view of the invention. FIG. 5 illustrates the neck pivot.

I claim:

1. A stringed musical instrument comprising:

a neck;

a chassis connected to an end of the neck;

means for supporting the instrument on the left leg of a user comprising a first block connected to the chassis;

a first rod secured to said first block and a left leg support attached to said first rod;

means for supporting the instrument on the right leg of the user comprising a second block connected to the chassis; a second rod secured to said second block and a right leg support attached to said second rod; and, means for supporting the instrument against the chest of the user comprising a third block connect to the chassis; and a chest support cushion secured to said third block.

2. The stringed instrument according to claim 1 further comprising:

a first knob securing said first block to said first rod;

a second knob securing said second block to said second rod; and, a third knob securing said third block to said chest support cushion.

3. The stringed instrument according to claims 1 further comprising:

a bridge secured to said chassis;

a piezoelectric pickup attached to said bridge; and, a plurality of vibration dampening grommets positioned between said bridge and said chassis.

* * * * *